US006677531B2

(12) United States Patent
Fukushima et al.

(10) Patent No.: US 6,677,531 B2
(45) Date of Patent: Jan. 13, 2004

(54) WATERPROOF STRUCTURE FOR TERMINAL

(75) Inventors: Hirotaka Fukushima, Shizuoka (JP); Yutaka Masuda, Shizuoka (JP); Hidehiko Kuboshima, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/171,678

(22) Filed: Jun. 17, 2002

(65) Prior Publication Data

US 2002/0189844 A1 Dec. 19, 2002

(30) Foreign Application Priority Data

Jun. 18, 2001 (JP) ..... P2001-182820

(51) Int. Cl.[7] ..... H01R 4/10
(52) U.S. Cl. ..... 174/84 C; 174/92
(58) Field of Search ..... 174/74 R, 84 C, 174/92; 336/92

(56) References Cited

U.S. PATENT DOCUMENTS 3,542,276 A * 11/1970 James ..... 228/2.5
4,612,680 A * 9/1986 Daiguji ..... 14/22
4,707,566 A * 11/1987 Titcombe et al. ..... 174/78
5,229,543 A * 7/1993 Strefling ..... 174/15.6
5,440,073 A * 8/1995 Lin et al. ..... 174/74 R

FOREIGN PATENT DOCUMENTS

JP 8-140253 5/1996

* cited by examiner

*Primary Examiner*—Chau N. Nguyen
(74) *Attorney, Agent, or Firm*—Sughrue Mion, PLLC

(57) ABSTRACT

A conductor crimping part is crimped onto a terminal metal fitting onto a conductor exposed at a terminal part of an electric wire. A crimped part of the conductor is intimately contacted with a rubber cap seal in such a way as not to be exposed to the outside. Thus, the conductor of the crimped part is sealed in such a manner as to prevent insulation performance from being degraded by infiltration of water contents and oil contents into a connecting part and permeation of the water contents and the oil contents among the wires, which respectively include the conductors.

6 Claims, 4 Drawing Sheets

WATERPROOF STRUCTURE FOR TERMINAL

The present application is based on Japanese Patent Application NO. 2001-182820, which is incorporated herein by reference.

BACKGROUND OF THE INVENTION

This invention relates to a waterproof structure for a terminal, which is enabled to prevent infiltration of water and oil into a conductor from a crimping part, which crimps a terminal metal fitting thereonto, at a terminal part of electric wires or cables (hereinafter referring to merely "wire") to thereby maintain insulation performance.

Generally, a terminal metal fitting is crimped onto a conductor, such as a stranded copper round wire exposed by peeling a coating, at a terminal part of each electric wire by caulking. Such a conductor is connected to an input/output terminal of electric equipment, for example, a motor mounted on an electric car through this terminal metal fitting to thereby perform electrical conduction of the equipment.

Especially, in the case of a vehicle traveling outdoors, there has been a drawback in that infiltration of water contents, such as carwash water, rain water, and muddy water, and various kinds of oil contents, such as lubricating oil and rust prevention oil, into a conductor of a part of a terminal of an electric wire arranged on a vehicle body degrades the insulation performance.

A conventional terminal proposed so as to solve such a problem of infiltration of oily water into the conductor is for example, a waterproof-type wire terminal shown in FIG. 4 and described in JP-A-8-140253. An insulating coating 2 of a terminal of a wire 1 is peeled off, so that a conductor 3 constituted by a stranded copper round wire is exposed, and that the exposed conductor 3 is connected to a conductor connecting part 5, which serves as an end part of a cylindrical terminal metal fitting 4, by being fitted thereto. Further, the other end part of the terminal metal fitting 4 is crushed flat as a terminal connecting part 6 by press-working. Simultaneously, two bolt holes 7 are provided in the terminal connecting part 6 by stamping.

In this wire terminal connecting structure, to prevent water contents and oil contents from infiltrating an inlet of a part, at which the conductor 3 is inserted and fitted into the conductor connecting portion 5 of the terminal metal fitting 4, a sealant 8, such as hotmelt, is applied onto the entire joint of a connection in such a way as to extend to the insulating coating 2 of an end part of the wire 1, and to thereby ensure sealing ability.

However, this conventional structure shown in FIG. 4 has the following problems.

One is that variation in the amount of an applied sealer and application unevenness thereof are apt to occur, because of the manual application of the sealer 8, and that reliable sealing cannot be ensured. Therefore, strict care should be paid to application management. Thus, the working cost thereof surges, while the production efficiency lowers.

Another is that when an external force, such as a bending force and a tensional force, are exerted on the wire 1, a crack and a peel-off occurs in the applied sealer 8, so that the sealing ability is impaired.

SUMMARY OF THE INVENTION

An object of the invention is to provide a waterproof structure for a terminal, which is enabled to prevent water contents and oil contents from infiltrating into a connecting part, in which a terminal metal fitting is crimped onto a terminal of an electric wire by caulking, and also prevent degradation in the insulation performance to thereby ensure desired sealing ability, and which is also enabled to simply and efficiently perform a sealing operation.

To achieve the foregoing object, according to the invention, there is provided a waterproof structure for a terminal (hereunder referred to a first structure of the invention), in which a terminal metal fitting 20 is crimped and connected to a conductor 11 exposed by performing a peeling operation on a terminal part of an electric wire 10, and in which this connecting part of the conductor is covered with an elastic member (corresponding to a cap seal) 30 that is intimately contacted with the connecting part from the outside to thereby ensure sealing ability, and in which the elastic member is covered with and held by a protecting member (corresponding to a cap holder) 40 in such a way as to compress the elastic member 30.

With the aforesaid configuration, the connecting part, at which the terminal metal fitting 20 is crimped onto the exposed conductor 11, is intimately contacted with the elastic member 30 in such a way as not to be exposed to the outside. Thus, the conductor 11 of the crimped part is sealed in such a manner as to prevent insulation performance from being degraded by infiltration of water contents and oil contents into a connecting part and permeation of the water contents and the oil contents among the wires, which respectively include the conductors 11. Further, such an elastic member 30 is accommodated and held in the protecting member 40 during a compressed condition thereof. Thus, the degree of intimate contact of the elastic member 30 with the connecting part is still more enhanced, and the reliability of sealing is still more improved. Furthermore, an operation of covering the connecting part with the elastic member 30, and an operation of accommodating and holding this elastic member 30 in the protecting member 40 can be achieved in a short time by almost one touch. As compared with a conventional operation of ensuring the sealing ability by applying hotmelt, the efficiency in sealing is still more increased. Consequently, the reliability in sealing is still more improved.

Further, according to the first structure of the invention, the elastic member 30 is a rubber barrel, which is intimately contacted with and has a length being equal to that of the entire connecting part extending from an outer peripheral surface of the terminal part of the electric wire 10, on which the peeling operation has been performed, to an outer peripheral surface of a partitioning wall part 23.

According to this configuration, the elastic member 30 is made of rubber. Thus, even when an external force due to the bend and warpage of the electric wire 10 is exerted onto the crimping part between the conductor 11 and the terminal metal fitting 20 after the connection therebetween, the elastic member 30 elastically expands and contracts flexibly in response to the external force. Thus, the degree of intimate contact can be maintained. Moreover, the drawbacks of the conventional structure, such as an occurrence of a peel-off of the sealing part, onto which hotmelt is applied, can be solved.

Furthermore, the protecting member 40 is shaped like a cap, in which the elastic member 30 having been in a compressed condition is detachably accommodated.

With this configuration, the elastic member 30 is accommodated and held in the cap-shaped protecting member 40 during compressed. Thus, the invention is effective in increasing the degree of intimate contact of the elastic member 30 still more by compression.

DETAILED DESCRIPTION OF THE PREFERRED EMBODIMENTS

Figure 1:
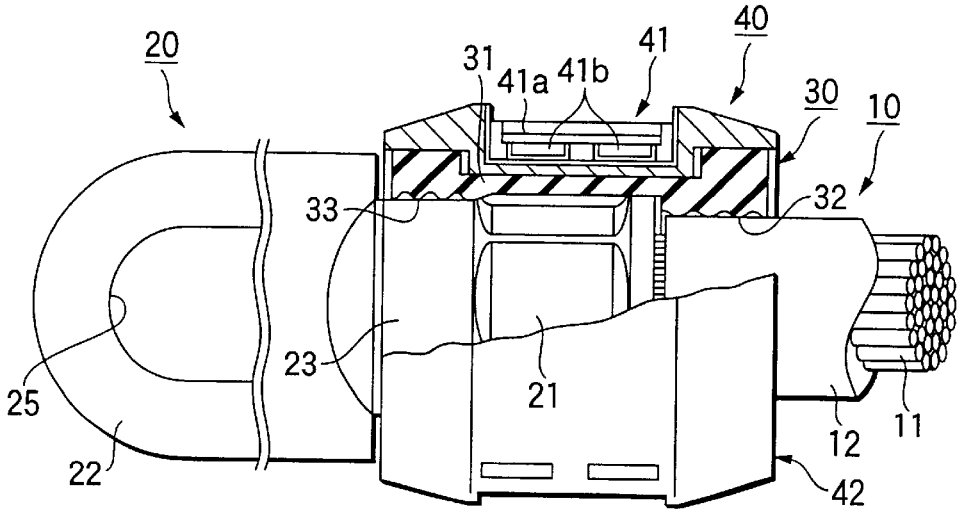
FIG. 1 is a partly broken assembly side view showing a waterproof structure for a terminal, which is an embodiment of the invention.
Figure 2:
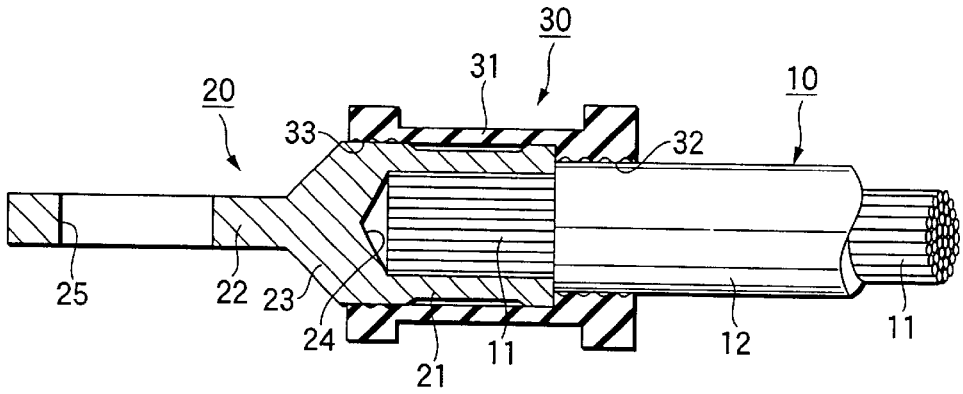
FIG. 2 is a side sectional view showing an assembly stage of the embodiment in a state in which a connecting part is covered with a cap seal after a conductor is crimped.
Figure 3A:
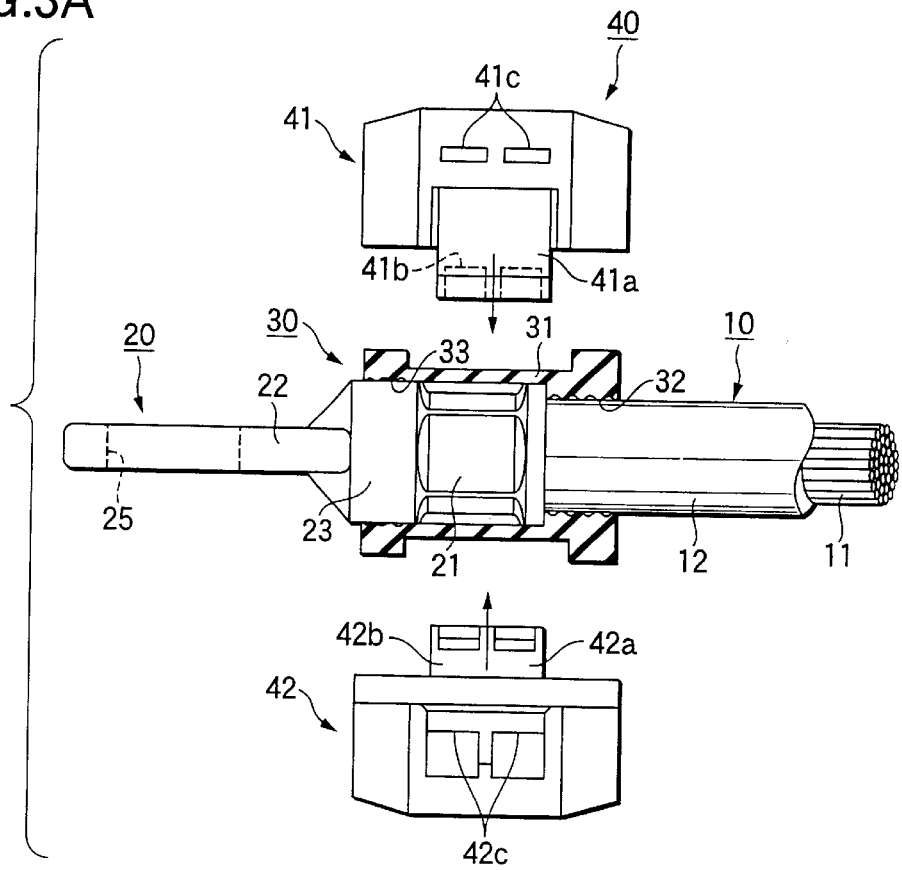
FIGS. 3A and 3B are exploded views each showing a final assembly stage of the embodiment in a state in which the cap seal is covered with and accommodated in a cap holder.
Figure 3B:
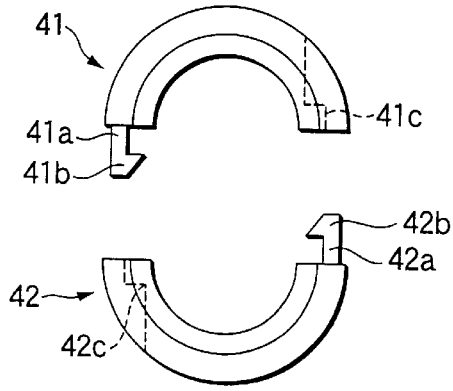
Figure 4:
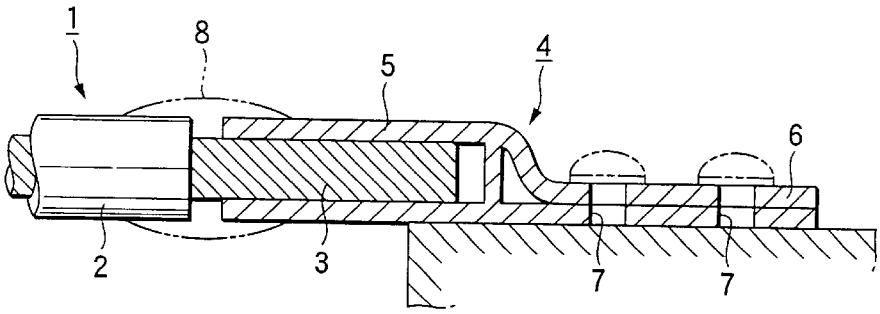
FIG.4 PRIOR ART
FIG. 4 is a side sectional view showing a conventional waterproof structure for a terminal.

Hereinafter, an embodiment of a waterproof structure for a terminal is described in detail with reference to the accompanying drawings. FIG. 1 is a partly sectional assembly side view showing the structure of this embodiment. FIG. 2 is a side sectional view showing a middle stage of an assembly process of the embodiment. Further, FIGS. 3A and 3B are exploded views each showing a final assembly stage of the embodiment.

An electric wire 10 is manufactured by forming insulating coating 12, which is made of an insulating material and a sheath, on a conductor 11, such as a copper wire, by extrusion molding. The conductor 11 is exposed by peeling the insulating coating 12 at a terminal part thereof. Then, a terminal metal fitting 20 is crimped onto and connected to the exposed conductor 11 by caulking.

As shown in FIG. 2, the terminal metal fitting 20 has a structure, in which an end part of an original barrel to be used as a mold workpiece is left as a conductor crimping part 21 remaining cylindrical, and in which a front part of the barrel is crushed flat by press working and simultaneously, bolt holes 25 serving as terminal connecting holes are formed by stamping, so that a terminal connecting part 22 is provided therein. The electrical wire 10 is electrically connected to equipment by being bolt-connected to an input/output terminal of the equipment through the bolt hole 25. A part between the conductor crimping part 21 and the terminal connecting part 22 of such a terminal metal fitting 20 is a crush-formed partitioning wall part 23. The conductor crimping part 21 remaining cylindrical and the terminal connecting part 22 are partitioned off by this flat partitioning wall part 22.

As is also shown in FIG. 2, the conductor 11 exposed at the terminal part of the wire 10 is inserted into the conductor crimping part 21, which remains cylindrical, of the terminal metal fitting 20 from behind. The conductor 11 is crimped by caulking the conductor crimping part 21 during a state in which the conductor crimping part 21 is made to abut against a abutting face 24 of the partitioning wall part 23. The conductor crimping part 21, especially, a conductor insertion hole is covered by and intimately contacted with a rubber cylindrical cap seal (corresponding to the elastic member) 30 from above so that such a crimped part of the conductor is not exposed to the outside.

This cap seal 30 has a length sufficient to permit the cap seal 30 to intimately contact with the outer peripheral surface of the insulating coating 12 of the peeled terminal part of the electric wire 10 and with the outer peripheral surface of the partitioning wall part 23 of the terminal metal fitting 20. The inner peripheral surfaces of end parts located in front and rear of a cap body part 31 of the cap seal 30, which is intimately contacted with the insulating coating 12 and the partitioning wall part 23, constitute intimately-contacted inner peripheral parts 32 and 33, in each of which indented parts, or concave and convex parts respectively shaped like a valley and a peak, and notches are formed. Thus, sealing ability against oily water is ensured by covering the entire connecting part with this cap seal 30 in such a way as to be intimately contacted therewith so as to prevent the insulation performance from being degraded by infiltration of water contents and oil contents into the connecting part and permeation of the water contents and the oil contents among the wires including the conductors 11.

Further, to still more enhance the reliability of sealing by this cap seal 30, as shown in FIGS. 3A and 3B, the structure has a two-piece cap holder (corresponding to the protecting member) 40 formed by plastics molding. The cap seal 30 put into a compressed condition is held in this cap holder 40.

The cap holder 40 consists of an upper holder 41 and a lower holder 42 (or a left holder and a right holder) of the separated two pieces thereof. Although the upper holder 41 and the lower holder 42 of an example shown in the figures respectively have shapes that are symmetric in an upward or downward direction, the shapes of the upper holder 41 and the lower holder 42 are not necessarily symmetric in such a direction. Moreover, even when the upper holder 41 and the lower holder 42 are not separated into two pieces, it is sufficient that the upper holder 41 and the lower holder 42 are shaped in such a way as to be connected to each other by a thin hinge part. In this case, locking arms 41*a* and 42*a* are provided at symmetric positions of the upper holder 41 and the lower holder 24. Locking hooks 41*b* and 42*b* are respectively provided at leading ends of the arms 41*a* and 42*a*. Further, locking recess parts 41*c* and 42*c*, which are respectively engaged with the locking hooks 41*b* and 42*b*, are provided at the symmetric positions of the upper holder 41 and the lower holder 42. Therefore, the upper holder 41 an the lower holder 42 can be assembled by almost one touch with click feeling by engaging each of the locking hooks 41*b* and 42*b* with a corresponding one of the locking recess parts 41*c* and 42*c*. Thus, the upper holder 41 and the lower holder 42 can be attached onto and detached from the cap seal 30.

With the aforesaid configuration, the conductor 11 of the part crimped onto the conductor crimping part 21 of the terminal metal fitting 20 is intimately contacted and covered with the cap seal 30 in such a way as not to be exposed to the outside. Thus, the connecting part is sealed in such a manner as to prevent insulation performance from being degraded by infiltration of water contents and oil contents thereinto from the conductor insertion opening of the conductor crimping part 21 and permeation of the water contents and the oil contents among the wires, which respectively include the conductors 11. Further, such a cap seal 30 is accommodated and held in the cap holder 40 during a compressed state thereof. Thus, the degree of intimate contact of the cap seal 30 with the connecting part is still more enhanced, and the reliability of sealing is still more improved. Consequently, an operation of covering the connecting part with the cap seal 30, and an operation of attaching the cap holder 40 to the protecting member can easily be achieved. Moreover, as compared with a conventional operation of ensuring the sealing ability by applying hotmelt, the efficiency in sealing is still more increased. Furthermore, the reliability in sealing is still more improved.

Further, the cap seal 30 is made of a rubber material. Thus, even when an external force due to the bend and warpage of the electric wire 10 is exerted onto the crimping part between the conductor 11 and the terminal metal fitting 20, the cap seal 30 elastically expands and contracts flexibly in response to the external force. Thus, the degree of intimate contact can be maintained. Therefore, the drawbacks of the conventional structure, such as an occurrence of a peel-off of the sealing part, onto which hotmelt is applied, when receiving an external bending force can be solved. Consequently, the reliability of sealing can be enhanced.

The material and shape of each of the cap seal 30, which serves as the elastic member, and the cap holder 40, which acts as the protecting member, of this embodiment are not limited to those shown in the figures and may be changed according to a using environment.

As described above, according to the first structure of the invention, the connecting part, at which the terminal metal fitting is crimped onto the exposed conductor, is intimately contacted with the elastic member in such a way as not to be exposed to the outside. Thus, the conductor of the crimped part is sealed in such a manner as to prevent insulation performance from being degraded by infiltration of water contents and oil contents into a connecting part and permeation of the water contents and the oil contents among the wires, which respectively include the conductors. Further, such an elastic member is accommodated and held in the protecting member during a compressed state thereof. Thus, the degree of intimate contact of the elastic member with the connecting part is still more enhanced, and the reliability of sealing is still more improved. Therefore, the invention has the following advantages. That is, an operation of covering the connecting part with the elastic member, and an operation of attaching the elastic member to the protecting member can be achieved in a short time by almost one touch. Moreover, as compared with a conventional operation of ensuring the sealing ability by applying hotmelt, the efficiency in sealing is still more increased. Furthermore, the reliability in sealing is still more improved.

Further, according to the second structure of the invention, a rubber material is employed as the material of the elastic member. Thus, even when an external force due to the bend and warpage of the electric wire is exerted onto the crimping part between the conductor and the terminal metal fitting after the connection therebetween, the elastic member elastically expands and contracts flexibly in response to the external force. Thus, the degree of intimate contact can be maintained. Moreover, the drawbacks of the conventional structure, such as an occurrence of a peel-off of the sealing part, onto which hotmelt is applied, can be solved.

Furthermore, according to the third structure of the invention, the elastic member is accommodated and held in the cap-shaped protecting member during compressed. Thus, the invention is effective in increasing the degree of intimate contact of the elastic member still more by compression.

What is claimed is:

1. A waterproof structure for a terminal comprising:

a terminal metal fitting including a conductor crimping part, a terminal connecting part and a partition wall part provided between the conductor crimping part and terminal connecting part, said conductor crimping part being crimped and connected to an exposed portion of a conductor at an end of an electric wire that includes said conductor and an insulating coating;

an elastic member for sealing at least a part of said insulating coating and a part of said partition wall part; an inner peripheral surface of said elastic member being in intimate contact with an outside of said insulating coating and an outside of said partition all part; and a protecting member accommodating said elastic member in such manner that said elastic member is brought into a compressed state therein.

2. A waterproof structure for a terminal as set forth in claim 1, wherein said elastic member is a rubber barrel and covers an area extending from an outer peripheral surface of said electric wire to an outer peripheral surface of said partition wall part.

3. A waterproof structure for a terminal as set forth in claim 1, wherein said protecting member is shaped like a cap, in which said elastic member having been in a compressed condition is detachably accommodated.

4. A waterproof structure for a terminal as set forth in claim 3, wherein said protecting member is constituted by a pair of holders so as to be separated in two pieces thereof.

5. A waterproof structure for a terminal as set forth in claim 4, wherein a pair of locking arms are provided in a symmetric manner in said pair of holders and a pair of locking recess parts respectively engageable with said pair of locking hooks are provided in said pair of holders in a symmetric manner.

6. A waterproof structure for a terminal as set forth in claim 1, an indented part is formed on an inner peripheral surface of said elastic member.

* * * * *